United States Patent [19]

Hideg

[11] 4,357,923

[45] Nov. 9, 1982

[54] FUEL METERING SYSTEM FOR AN INTERNAL COMBUSTION ENGINE

[75] Inventor: Laszlo Hideg, Dearborn Heights, Mich.

[73] Assignee: Ford Motor Company, Dearborn, Mich.

[21] Appl. No.: 195,170

[22] Filed: Oct. 7, 1980

Related U.S. Application Data

[63] Continuation-in-part of Ser. No. 79,294, Sep. 27, 1979, abandoned.

[51] Int. Cl.[3] ..... F02B 3/00; F02D 31/00

[52] U.S. Cl. ..... 123/492; 123/493; 123/480

[58] Field of Search ..... 123/492, 493, 480

[56] References Cited

U.S. PATENT DOCUMENTS

| | | | |
|---|---|---|---|
| 2,859,738 | 11/1958 | Campbell | 123/492 |
| 3,608,532 | 9/1971 | Balluff | 123/492 |
| 3,670,706 | 6/1972 | Fujisawa | 123/492 |
| 3,794,003 | 2/1974 | Reddy | 123/492 |
| 3,964,443 | 6/1976 | Hartford | 123/492 |
| 3,969,614 | 7/1976 | Moyer | 123/492 |
| 4,086,884 | 5/1978 | Moon | 123/492 |
| 4,245,605 | 1/1981 | Rice | 123/492 |
| 4,266,275 | 5/1981 | Marchak | 123/492 |
| 4,266,522 | 5/1981 | Williams | 123/492 |

*Primary Examiner*—Ronald B. Cox

*Attorney, Agent, or Firm*—Peter Abolins; Clifford L. Sadler

[57] ABSTRACT

Applicant's invention includes an improved fuel metering system which is particularly suitable for use with spark ignition and internal combustion engines controlled by digital computers programed to calculate repetitively a value representing a current transfer rate of the intake surface fuel and the calculated value being used to modify the rate at which fuel otherwise would be metered into the engine's intake passage. In particular, modification of the rate at which fuel is metered into the engine's intake passage takes into account the current equilibrium intake surface fuel quantity, the current intake system time constant, and the current actual intake surface fuel. From these quantities the current trend for rate of intake surface fuel is calculated. In a calculation of the current actual intake surface fuel, a previous value of the actual intake surface fuel is used in combination with a previous value of the transfer rate of intake surface fuel. Additionally, a clock is used to establish a time span.

5 Claims, 6 Drawing Figures

Temperature Factor - TF

| Engine Coolant Temperature - ECT (°F+60°) | 40 | 70 | 190 | 300 |
|---|---|---|---|---|
| 300 | 1 | .8 | .4 | .1 |
| 190 | 1.2 | 1 | 1 | .4 |
| 70 | 1.6 | 1.0 | 1 | .7 |
| 40 | 1.8 | 1.6 | 1.3 | 1 |

Manifold Charge Temperature - MCT (°F)

FIG. 4.

Steady State Mass - MSS ($10^{-5}$ lb)

| Manifold Absolute Press. - MAP (Inches of Mercury) | 0 | 2000 | 4000 |
|---|---|---|---|
| 30 | 90 | 90 | 90 |
| 15 | 45 | 45 | 45 |
| 0 | 0 | 0 | 0 |

RPM

FIG. 5.

Tau - $\tau$ (sec.)

| Manifold Absolute Press. - MAP (Inches of Mercury) | 0 | 2000 | 4000 |
|---|---|---|---|
| 30 | 2 | 2 | 2 |
| 15 | 2 | 2 | 2 |
| 0 | 2 | 2 | 2 |

RPM

FIG. 6.

FUEL METERING SYSTEM FOR AN INTERNAL COMBUSTION ENGINE

This is a continuation-in-part of application Ser. No. 79,294, filed Sept. 27, 1979, and now abandoned.

BACKGROUND

This invention relates to a fuel metering system having improved ability to handle transient fuel metering modes of operation. More particularly, it relates to a fuel metering system for an internal combustion engine wherein the fuel control system of the engine is better enabled, as compared to the prior art, to handle the transient conditions that occur during engine accelerations, decelerations (negative acceleration) and other conditions that cause fluctuations to occur on a temporary basis in the flow of fuel from the engine's primary fuel metering apparatus to its combustion chamber or chambers.

In internal combustion engines, the rate at which fuel is metered to the engine varies during engine operation. Changes in engine load cause the engine's fuel metering apparatus to increase or to decrease the rate at which fuel is metered to the engine. As a result, the engine must change from a first state, where engine operation and fuel flow rate is quite stable, to a second state, where these conditions again become stable. The conditions in between the stable states are of a transient character in that the rate of fuel flow varies continuously and can produce undesirable air/fuel ratios. For example, with carburetion or other central location of the fuel metering apparatus, there is an intake manifold passage that the vaporized or atomized fuel must traverse in order to reach the engine's combustion chamber or chambers. At a given engine load, prior art fuel control systems under transient engine operation are unable to maintain precise air/fuel ratios until the conditions in the engine's intake passages have stabilized. Sudden accelerations cause an increase in the rate at which liquid fuel is deposited on the walls of the intake passages (wall wetting), and sudden decelerations produce a lessened rate of deposition. The reason for this has to do with the changing vapor pressures. The higher the vapor pressure, the more the fuel tends to accumulate on the walls of the intake passages. Vapor pressure is a partial pressure, and the major contributor to pressure in the intake passage is air. The air pressure in the intake passages in general is below atmospheric, unless the usual throttle valve is fully open, during engine operation.

While the wall-wetting changes, the amount of fuel metered by the fuel metering apparatus on the engine is not the amount of fuel that actually reaches the engine's combustion chambers within the charge transport time (air/fuel delivery time) applicable to the particular engine speed and load conditions at the time. The engine speed and load under stable engine operating conditions are the factors primarily determinative of the transport time of the air/fuel mixture from the fuel metering apparatus to the engine's respective combustion chambers. This applies to both central point fuel metering and multipoint fuel metering systems. Central point fuel systems include both the conventional carburetion system and the recently developed central point fuel injection system that has two electromagnetic fuel injectors positioned in a throttle body (air valve) to inject fuel into the incoming airstream. The multipoint system is exemplified by electronic fuel injection systems that provide an electromagnetic fuel injector for each of the engine's combustion chambers, with each injector injecting fuel into the intake passage immediately upstream of the intake valve for the associated combustion chamber.

PRIOR ART

A search of the prior art has not revealed any patents of particular relevance with respect to the subject matter hereof. However, the following patents are of general background interest.

U.S. Pat. No. 3,794,003 to Reddy teaches an electronic deceleration control system which is responsive to engine RPM and intake manifold absolute pressure. The system computes the first derivative of the manifold pressure to provide an immediate indication of the deceleration demand independent of throttle position or minimum manifold pressure. The system curtails or terminates fuel delivery to the engine when manifold pressure is above a predetermined value. Fuel delivery is restored after the manifold pressure has returned above a second predetermined value. Engine RPM also is a factor employed in this fuel control system.

U.S. Pat. No. 3,969,614 to Moyer et al is incorporated by reference discloses an engine control system employing a digital computer that calculates on a real-time basis the proper setting for one controlled variable while taking into account the effect of a setting of another controlled variable to provide stable engine operation at all times. The computer is programmed to repetitively calculate values for the controlled variables from an algebraic function or functions describing a predetermined desired relationship between a first controlled output variable and a second controlled output variable.

U.S. Pat. No. 3,964,443 to Hartford teaches a digital engine control system that may be used to control a fuel injection system in which engine intake manifold pressure, engine RPM and engine temperature are utilized as inputs to a computer.

U.S. Pat. No. 4,086,884 to Moon et al is incorporated by reference and teaches a fuel control system for a spark ignition internal combustion engine wherein the fuel is delivered with central point point fuel injection. The fuel injection pulse width determines the quantity of fuel delivered to the engine and this is calculated by the speed-density approach for determining the mass air flow.

SUMMARY OF THE INVENTION

In accordance with the invention, an improved fuel metering system is provided that is particularly suitable for use with a spark ignition internal combustion engine. The principles of the improvement may, however, be extended to other engine designs, such as Diesel, external combustion and turbine. Each of these other engine types requires an air/fuel mixture and may need the transient control provided by the invention. A Diesel engine involves the direct injection of fuel into the engine's combustion chamber or prechamber (indirect injection Diesel), but the quantity of fuel that remains on the walls of the combustion chamber or prechamber and the variation of such quantity may be of considerable importance in the adequate control of Diesel engine exhaust emissions and fuel economy. Continuous combustion engines, on the other hand, do not require the degree of fuel control required by internal combustion engines because combustion is continuous and an excess of air is always available. It is not inconceivable, however, that such engines may one day require compensation for transient deposits of fuel in the intake passage to the "external" combustion chamber of such an engine. Such compensation would be of particular importance where the response of the engine to changes in rate of fuel flow is significant.

The improved fuel control system of the invention is designed to take into account the variations that occur in the quantity of fuel that is deposited in the liquid state in the intake passage or passages of an engine. The air/fuel ratio of the mixture in the intake passages varies depending upon the initial metering of fuel in proportion to the incoming air and also as a function of the net transfer of fuel from the surfaces of the intake passages to the inducted air/fuel mixture or vice versa. The incoming air, after being mixed with fuel at some point or points in the intake passage, flows into the engine's combustion chambers. Liquid fuel on the walls of the combustion chambers may be included in the net transfer.

In accordance with the invention, an improved fuel metering system for an engine having an intake passage comprises fuel metering apparatus and means associated with the fuel metering apparatus for taking into account the rates of deposition and removal of liquid fuel on or from the surfaces of the engine's intake passages. The liquid fuel on the walls of the intake passage is transferred into and removed from the air/fuel mixture that flows through the intake passages into the combustion chambers. This transfer and removal occurs at a rate which varies both locally within the passage and also on an overall basis. The variations of rate are a function of engine speed, load on the engine, engine and intake air and fuel temperatures, and some other less significant parameters.

BRIEF DESCRIPTION OF THE DRAWINGS

FIG. 4 is a look-up table for a temperature factor from a table having coordinants of engine coolant temperature (ETC) expressed in degrees Fahrenheit plus 60° Fahrenheit versus the manifold charge temperature (MCT) in degrees Fahrenheit;

FIG. 5 is a look-up table for a steady state mass (MSS) expressed in $10^{-5}$ lbs. from a table having coordinants of manifold absolute pressure (MAP) expressed in inches of mercury versus engine RPM's; and FIG. 6 is a look-up table for a time constant $\tau$ (Tau) expressed in seconds from a table having coordinants of manifold absolute pressure (MAP) expressed in inches of mercury versus engine RPM's.

DETAILED DESCRIPTION

Figure 1:
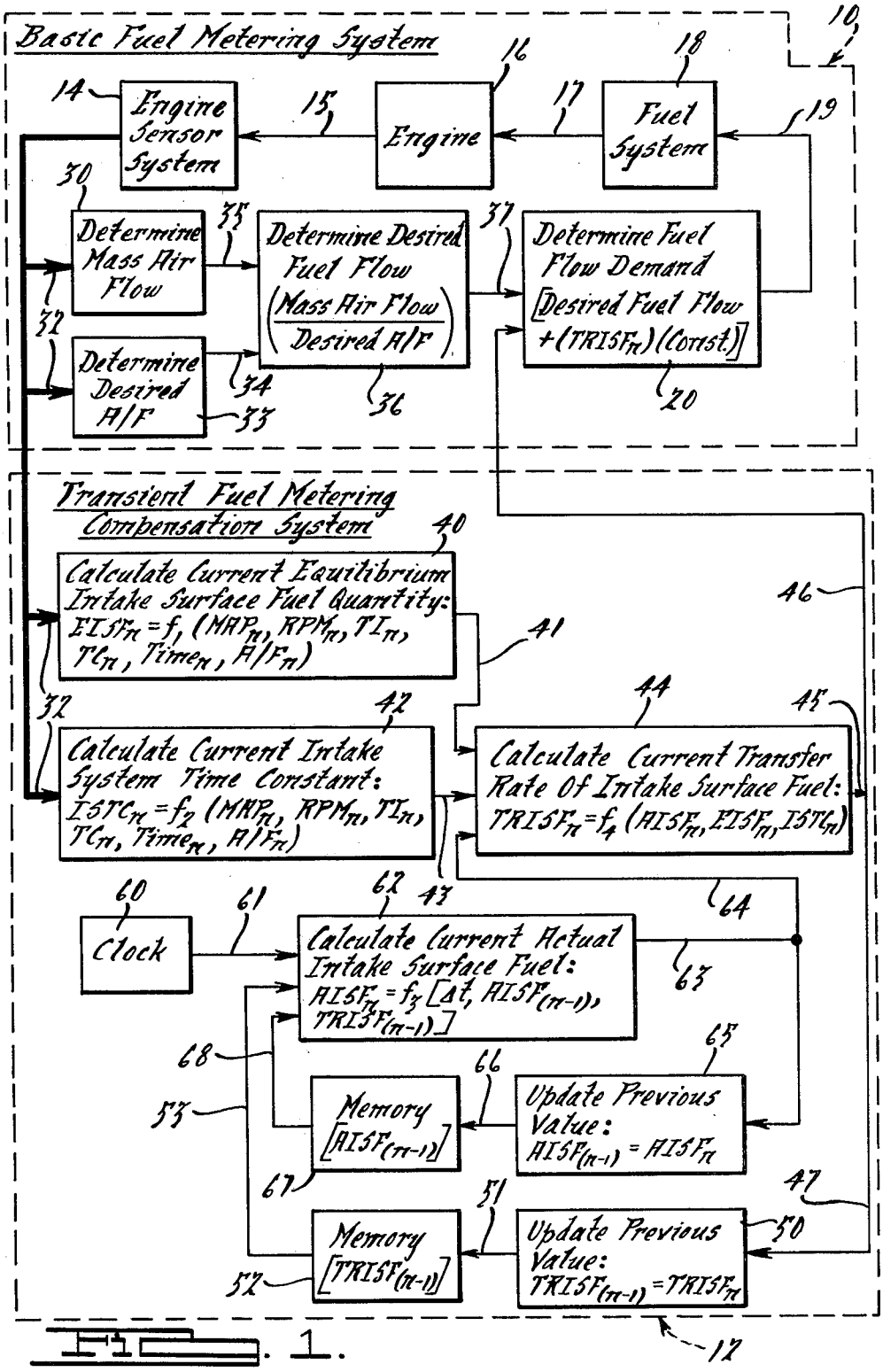
FIG. 1 is a schematic block diagram of a basic fuel control system and a transient compensation system that is used to modify as necessary the computer-calculated fuel quantity determined by the basic system.

With reference now to the drawings, there is shown in FIG. 1, a basic fuel metering system 10 and a transient compensation fuel metering system 12. The basic fuel metering system has an engine 16 that produces certain operational conditions that are sensed via an engine sensor system 14, as is indicated by the arrow 15. With the sensor system connected by electrical leads 32, which may be in the form of a data bus for transmitting digital information, the engine operating conditions may be used in the computer calculation of the rate at which it is desired that fuel be metered to the engine 16 at a particular instant in time. This rate is calculated by the basic fuel metering system 10. Fuel is supplied to the engine with the use of a fuel system 18 that delivers fuel to the engine, as indicated by arrow 17, in response to a suitable signal appearing on the electrical or mechanical path represented by the arrow 19.

The basic fuel metering system 10 preferably includes a digital computer of the type employed in the fuel metering system described in commonly assigned U.S. Pat. No. 3,969,614 to Moyer et al and preferably is capable of calculating a fuel injection pulse width to provide a desired air/fuel ratio. The pulse width may be determined by the use of a computer calculation that determines the quantity of fuel to be delivered to the engine per injection in response to the mass air flow into the engine's intake passages at the time of injection. A mass air flow meter or other device may be used to determine directly the mass air flow. Alternatively, a speed-density type of indirect determination of mass air flow into the engine may be made, as is done with the improved fuel metering system described in commonly-assigned U.S. Pat. No. 4,086,884 to Moon et al. The system of the Moon et al patent now has been further improved in the manner described in commonly-assigned U.S. Patent application Ser. No. 72,293 filed Sept. 27, 1979 in the names of J. W. Hoard and R. R. Tuttle and entitled "A Method for Improving Fuel Control in an Internal Combustion Engine", the disclosure of which is hereby incorporated by reference.

The transient fuel metering compensation system 12 is intended to modify the basic rate of fuel metering calculated by the digital computer. The compensation takes into account the rate at which fuel is removed from or added to the liquid residing on the surfaces of the engine's intake passages. This transfer rate, if necessary, may include variations in the quantity of liquid fuel that remains within the combustion chamber of the engine as a deposit on its walls. When the fuel metering rate (a fuel injector pulse width multiplied by the number of injections per unit time and the fuel delivery rate during injection) is calculated by the basic fuel metering system 10, the rate of mass air flow into the engine must first be determined as indicated at 30 in FIG. 1. At 33, a desired air/fuel ratio is determined based upon the engine operating conditions prevailing as of the time the rate of mass air flow is determined. Via the electrical or computer paths 34 and 35, the digital computer determines a desired rate of mass fuel flow into the engine by dividing the rate of mass air flow by the desired air/fuel ratio. The result, on electrical or computer path 37, then is used in the computation of a fuel flow demand, that is, a fuel flow rate that takes into account the transfer of fuel onto and from the quantity of liquid fuel residing on the surfaces of the engine's intake passages. This fuel flow demand appears on electrical or mechanical path 19 and controls the metering of fuel by the fuel system 18.

The fuel system 18 may be a conventional carburetor or a set of electromagnetic fuel injectors. In the preferred form of the invention, the fuel system is a throttle body mounted on the engine's intake manifold. The throttle body has two electromagnetic fuel injectors positioned to inject liquid fuel into the airstream entering the intake manifold through the throttle body. The injectors may be pointed downwardly at a location just above the throttle plate or plates mounted within the throttle body to control the rate of mass air flow into the engine.

The fuel flow demand is determined at point 20 in the system depicted in FIG. 1. This signal is a combination of the desired fuel mass flow rate with a second rate term, identified ($TRISF_n$) (constant). The second term accounts for variation in the quantity of liquid fuel residing on the surfaces of the engine's intake passages. The constant in this term is a scaling factor. The factor $TRISF_n$ is the transfer rate of the fuel on the surfaces of the engine's intake passages. This factor, along with other quantities used in the description below, is defined as follows:

$$TRISF = \frac{d(AISF)}{dt} = \text{Transfer Rate of the Intake Surface Fuel}$$

AISF=Actual Intake Surface Fuel;
EISF=Equilibrium Intake Surface Fuel;
ISTC=Intake Surface Time Constant.

The transfer rate is expressed in units of mass per unit time. Actual and equilibrium intake surface fuel is expressed in mass units, and the intake surface time constant is in units of time. The intake surface time constant is a measure of the actual time required for fuel leaving the liquid state on the intake surfaces to become a gas or vapor in the intake mixture moving toward the engine's combustion chamber or chambers and vice versa.

The product of the transfer rate of the intake surface fuel and the time constant is equal to the difference between the equilibrium intake surface fuel and the actual intake surface fuel, or, stated mathematically:

$$(TRISF)\,(ISTC) = ISTC\,\frac{d(AISF)}{dt} = EISF - AISF$$

This is a differential equation. Under steady state conditions, d(AISF)/dt is equal to zero and the actual intake surface fuel AISF is the equilibrium intake surface fuel. However, under transient conditions of engine operation, where the equilibrium intake surface fuel EISF is changing between two different values corresponding to two different states of substantially stable engine operation, the differential equation above may be solved for the purpose of allowing the engine's fuel metering system to take into account the quantity of fuel entering and leaving the induction stream due to changing EISF states. The fuel flow demand is a fuel flow rate equal to the desired fuel flow rate less the net transfer rate from the intake surfaces to the inducted mixture.

The desired fuel flow rate is calculated as previously described, but the TRISF compensation of the basic fuel metering system computation is accomplished separately by the digital computer preferably used to handle both the basic fuel metering and TRISF computations. In the transient compensation system, the $EISF_n$ is calculated or is found in computer tabular memory and is available as a number applicable to the particular engine operating conditions prevailing at the time the fuel metering computation is being made. The subscript "n" denotes the current EISF, AISF and TRISF values and the subscript "(n−1)" denotes the values thereof at a prior time, such as the immediately preceding computer computation cycle.

In the solution of the differential equation defining TRISF, several computer or electronic techniques could be employed. There are several mathematical methods of approximating the solution using a trial and error technique. The solution also may be obtained by employing tables that contain TRISF values for various engine operating conditions. The preferred form of the invention uses a combination of these techniques and approximates the solution to the equation based upon results obtained from a prior solution. The prior solution, as well as the solution in progress at a given time, is calculated from values obtained in the prior solution of the differential equation as well as with the use of a table of values for the equilibrium intake surface fuel (EISF).

Figure 2:
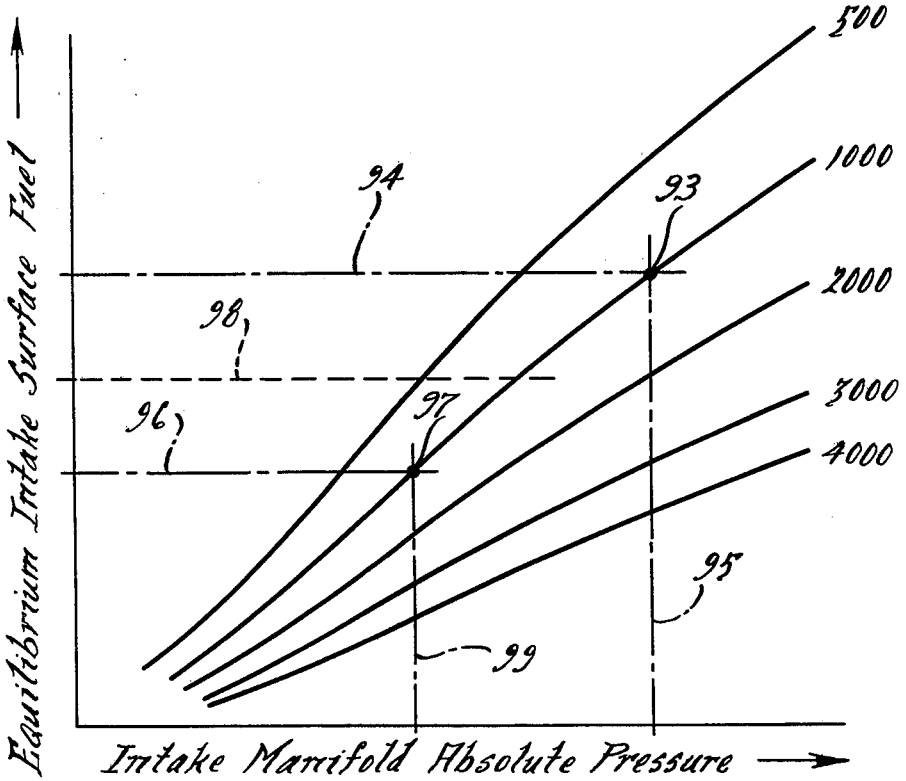
FIG. 2 is a graph of the intake manifold absolute pressure of an internal combustion engine versus the quantity of liquid fuel residing on its intake manifold under equilibrium conditions of engine operation.

The EISF may be expressed as a function of one or more engine operating parameters, such as engine speed and engine load. In FIG. 2, EISF is related to intake manifold absolute pressure, a quantity that is closely related to the load on the engine. Other parameters indicative of intake air or mixture flow rate or indicative of engine torque also may be used. A family of curves is shown to indicate that EISF also is a function of engine speeds indicated by RPM numbers that appear at the right-hand side of each curve. The variables could be interchanged if a different family of curves were to be used. Points 93 and 97 on the 1000 RPM curve designate two different engine power output requirements at the same engine speed. In a vehicle application of an engine, this might correspond to a change from operation of the vehicle on level ground to operation on an upward incline with increased throttle opening to maintain engine speed. In such situation, the engine speed would remain substantially constant if the throttle valve (conventionally used on the engine to control airflow and power output) were to be opened to icrease the engine's power output. Opening of the throttle causes the intake manifold absolute pressure (MAP) to increase and thus, engine operation shifts from point 97 to point 93. Pressures corresponding to these points are indicated by lines 99 and 95 respectively. The EISF values at these points are respectively indicated by lines 96 and 94.

Line 98 in FIG. 2 designates an actual intake surface fuel (AISF) that necessarily occurs at some time between equilibrium engine operation at points 97 and 93. The AISF value or values occurring between equilibrium points are used in determining the transfer rate of the intake surface fuel and determination therefrom of the fuel flow demand as indicated in block 20. In this way, transient compensation of the fuel metering rate calculated by the basic system 10 may be achieved to take into account the liquid fuel transferred from the engine's intake passages to its induction mixture and vice versa.

The intake surface fuel at equilibrium engine operation is not changing and can be ignored. During changes or transients occurring in engine operation, however, accurate fuel metering requires that allowance be made for the contribution of the inducted air/fuel mixture to the quantity of liquid fuel residing on the intake passage surfaces or the contribution of fuel to the air/fuel mixture from the intake surface deposits. The fuel leaving the intake surfaces becomes an aerosol or vapor or gas and mixes with the air and fuel moving along the intake passage. This intake surface fuel is added to the metered quantity of fuel as determined by the current fuel setting. On the other hand, gaseous fuel that is deposited on the intake passage surfaces undergoes a change in state and subtracts from the quantity of fuel that actually reaches the engine's combustion chamber.

When fuel is added to the air/fuel mixture, it must be subtracted from the desired quantity that is obtained from the step indicated in block 36 of FIG. 1. Thus, fuel that is removed from the walls of the intake passages and added to the inducted mixture is given an opposite mathematical sign as compared to the desired fuel flow so that, when combined in an additive process, the result is a value that represents the actual fuel flow demand, that is, the quantity of fuel that must be metered to provide the desired air/fuel ratio, taking into account the transient fuel addition provided by the fuel removed from the intake passage surfaces and inducted into the engine's combustion chambers. Of course, fuel removed from the air/fuel mixture moving toward the combustion chambers is given the same mathematical sign as the desired fuel flow so that, when combined in additive fashion therewith, the fuel flow demand will include an extra allowance for that fuel which is removed from the inducted mixture and deposited on the intake passage surfaces.

When the fuel flow demand is the same as the desired fuel flow determined as indicated by block 36, the fuel supply system is not providing any transient compensation. The air/fuel ratio of the air/fuel mixture inducted into the engine under transient conditions is a combination of the metered fuel and the quantity of fuel obtained from or added to that deposited previously on the intake passage surfaces. This latter quantity is obtained as a result of changes in the pressure within the intake manifold under the various conditions of engine operation. If the pressure increases as a result of increased throttle opening or reduced load on the engine, then the partial pressure of oxygen and noncombustible gases in the intake mixture increases correspondingly and the partial pressure of the fuel vapor decreases. Fuel removed from the mixture of gases deposits as a liquid on the surfaces of the intake passages. Conversely, if the fuel partial pressure increases as a result of other partial pressures that are reduced, the amount of liquid fuel deposited on the intake passage surfaces decreases and the fuel removed from that residing on the surfaces is inducted into the engine's combustion chambers. In addition to pressures, there are other factors that influence the quantity of liquid fuel on the surfaces of the engine's intake passages.

When the air supplied to the engine is cold, the amount of liquid fuel deposited on the intake passage surfaces is greater than it is as the engine warms up. This is because the partial pressure of the engine's intake air is greater at lower temperatures than it is at higher temperatures, and also because the fuel condenses more easily at the lower temperatures. Also, at lower intake air or fuel temperatures, the fuel metering device or system 18 employed may not be as effective in thoroughly mixing the air and fuel inducted into the engine. For these reasons, it conventionally has been necessary to employ fuel enrichment devices and techniques (the general equivalent of the choke function conventionally employed on spark ignition engines) in order to compensate for operation at lower temperatures. Unfortunately, the fuel enrichment that occurs results in increased hydrocarbon engine exhaust emissions and this has necessitated the use of elaborate choke control devices and systems to reduce the hydrocarbon emissions as much and as rapidly as possible. Such reduction of the hydrocarbon emissions has impeded or reduced the performance of the associated engines during the warm-up period.

The temperature of the intake system or its constituents is of significance with respect to the quantity of liquid fuel that can be deposited on the intake surfaces of the engine. The engine's intake passages may contain air, air and fuel in mixture, or air, fuel and exhaust gas in mixture. The temperature of any of these, or of the engine and its intake conduit, may be used in the determination of the rate at which fuel is transferred to and from the intake mixture from and to the intake passage surfaces. The physical properties of the fuel itself also are of importance and vary both geographically and seasonally.

When it is desired to compensate the rate at which fuel is metered to the combustion chamber or chambers of an engine for variations in the quantity or rate of transfer of liquid fuel residing on the intake passages surfaces in the engine, this may be accomplished in the manner depicted in the transient fuel metering system 12 of FiG. 1.

In the FIG. 1 transient fuel metering compensation system 12, the value of the current transfer rate of intake surface fuel $TRISF_n$ appears on path 46 leading to block 20 in the basic fuel metering system 10. The $TRISF_n$ value is a number that is repeatedly calculated and updated based upon changes in various engine operating parameters. As indicated in block 44, the current transfer rate of the engine's intake surface fuel is a function $f_4$ of variables that may be related to one another as follows:

$$TRISF_n = \frac{EISF_n - AISF_n}{ISTC_n} \quad (1)$$

The $TRISF_n$ value cannot be calculated in the block 44 computer step until the $EISF_n$, $AISF_n$ and $ISTC_n$ values are known on a real-time basis, that is, while the engine is operating and being controlled by the basic and transient compensation fuel metering systems 10 and 12. $EISF_n$ can be determined from the engine operating parameters illustrated in FIG. 2, but in reality is a function $f_1$ of engine intake manifold absolute pressure, engine speed, engine intake air or mixture temperature, engine intake system temperature (here partially represented by the engine coolant temperature $TC_n$), time and air/fuel ratio ($A/F_n$). Fuel physical properties also may be considered. The $A/F_n$ is, of course, the ratio of air to fuel within the gaseous mixture adjacent the surfaces of the intake passage and varies with position within the intake passage. The $EISF_n$ also may be obtained from a computer memory which has stored within it constants that define the slope and EISF axis intercepts of a family of curves that can represent one or more of the curves illustrated in FIG. 1. If this is the case, engine speed $RPM_n$ may be used to select the proper set of constants and a single value of the intake manifold absolute pressure (MAP) may be used to obtain a value for the current equilibrium intake surface fuel $EISF_n$. Of course, the variables may be interchanged if desired. In any event, the current $EISF_n$ is determined from values of one or more engine operating parameters.

The $TRISF_n$ value of equation (1) cannot be determined until the $AISF_n$ and $ISTC_n$ values have been obtained; the former is subtracted from the $EISF_n$ value obtained as described in the preceding paragraph and the difference between the $EISF_n$ and $AISF_n$ values is divided by $ISTC_n$, the current intake surface time constant.

$AISF_n$ is approximately equal to the previous actual intake surface fuel $AISF_{(n-1)}$ modified to account for changes that may have occurred during the time elapsed since $AISF_{(n-1)}$ was determined. If $AISF_n$ is regarded as a function $f_3$ of the elapsed time $\Delta t$ just mentioned, of $AISF_{(n-1)}$ and of $TRISF_{(n-1)}$, the following equation results;

$$AISF_n = AISF_{(n-1)} + [TRISF_{(n-1)}][\Delta t]. \quad (2)$$

From equation (2) above, it is clear that $AISF_n$ can be determined, at least to a good approximation, from previous values of TRISF an AISF used to effect compensation of the basic fuel metering system 10 or variations in the quantity of liquid fuel on the engine's intake passage surfaces.

The $ISTC_n$ is a time constant that represents the current or instantaneous rate at which fuel is being transferred from the liquid state on the intake surfaces to the vapor or gaseous state in the inducted mixture or vice versa. In view of this, the $ISTC_n$ may be described as a function of one or more engine operating parameters that influence this rate of transfer. Thus, as is indicated in block 42 of FIG. 1, $ISTC_n$ is a function $f_2$ of intake manifold absolute pressure, engine speed, engine air or intake mixture temperature, engine intake system temperature, time, $A/F_n$, and the physical properties of the fuel. The intake surface time constant is not a constant in the sense that it does not change, but rather is variable under some engine operating conditions.

The ISTC is a measure of the time required for a fraction of the fuel that will be transferred, in response to a difference between the equilibrium intake surface fuel $EISF_n$ and the actual intake surface fuel $AISF_n$ existing during the transient engine operation, to be transferred. Variation in the ISTC results primarily from variations in the engine intake system temperature and the temperature $TI_n$ of the intake air or gaseous mixture; there may be other engine operating parameters, such as the intake manifold absolute pressure, engine speed, or time in the engine cycle, that affect the ISTC. The ISTC variation is analogous to the variation of an RC time constant in an electrical circuit as a result of temperature or other variations that cause the resistance and capacitance values to change. At normal engine operating temperatures, the ISTC may be regarded as a constant, but for more accurate fuel metering capability, it is desirable to use a plurality of values for the ISTC. The values may be selected for a particular temperature range in which the engine is operating or some other parameter of engine operation may be selected for the determination of which value for ISTC will be used.

If the ISTC value is selected from a table or if it is calculated from an equation programmed into the digital computer, then the ISTC becomes a variable that takes into account variations in the physical properties of the engine's intake manifold and its contents. This is analogous, mathematically, to the variations in an RC time constant of an electrical circuit which variations would be due to changes in the resistance R and capacitance C values that determine the time constant. The ISTC changes that result from variation of engine intake system physical properties are primarily due to engine operating and intake air temperature variations. These variations are quite minor after engine warm-up.

After the ISTC has been selected, the digital computer is allowed to calculate the current transfer rate of the intake surface fuel $TRISF_n$ from equations (1) and (2) above. The $TRISF_n$ is applied via path 46 to the determination of the fuel flow demand in the basic system 10, as shown in block 20.

After the $TRISF_n$ value is determined, the value is provided via path 47 to a memory update of the previous value. Otherwise stated, the latest or most current value $TRISF_n$ replaces the previous value $TRISF_{(n-1)}$, as indicated by block 50 in FIG. 1, and the updated value is applied to a memory 52 over path 51. The memory uses the updated value as the value for $TRISF_{(n-1)}$ in equation (2) above for the calculation of what is to become the next $TRISF_n$, which again causes the memory 52 to be updated.

Similarly, the value for $AISF_n$, determined with the use of equation (2) above, is calculated repeatedly. A clock 60 or pulse generator, conventionally required by a digital computer engine control system to update the fuel-metering control setting, is used in the computer determination of the time elapsed since the last update of the $AISF_n$ calculation. The current $AISF_n$ value is via line 63 to the calculation of the $TRISF_n$ value and also is made available, as indicated in block 65, for the update via path 66 of a memory 67 containing the $AISF_{(n-1)}$ value used in the calculation of a new $AISF_n$ from equation (2). This process preferably is repeated at the same rate at which the $TRISF_n$ calculations are made.

Figure 3:
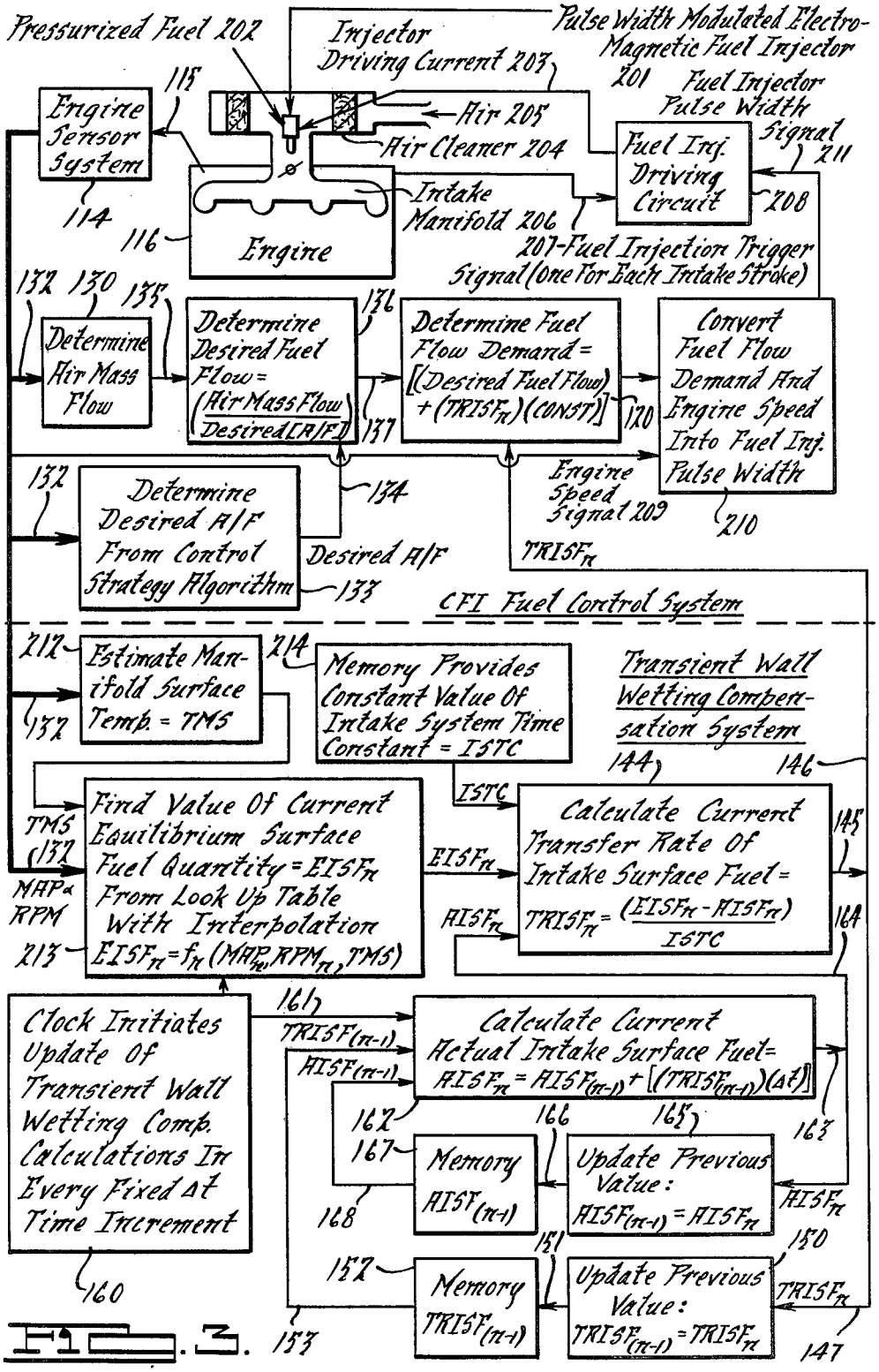
FIG. 3 is a schematic block diagram similar to FIG. 1 of a basic fuel control system and a transient compensation system showing a more detailed embodiment.

FIG. 3 shows a digitally controlled electronic central fuel injection system in accordance with an embodiment of this invention and in greater detail than shown in FIG. 1. Where there are common components the same numbering has been used with the addition of a one (1) in front so the numbers form a 100 series. A discussion of these components has already been presented in connection with FIG. 1. The components which have been added to FIG. 3, or replace components shown in FIG. 1 are discussed below and are numbered with a two (2) in front so they form a 200 series.

A pulse width modulated electromagnetic fuel injector 201 has an input of pressurized fuel on a line 202 and an input of injector driving current on a line 203. Air cleaner 204 has an input of air on a line 205 which is mixed with the fuel supplied by fuel injector 201 and passed into intake manifold 206. Engine 116 supplies a fuel injection trigger signal on a line 207 for each intake stroke to a fuel injection driving circuit 208. Injector driving current on a line 203 is supplied by fuel injection driving circuit 208. An engine speed signal on a line 209 is supplied by engine sensor system 114 to a block 210 which also receives an input from block 120. Block 210 converts fuel flow demand and engine speed into a fuel injector pulse width signal which is supplied on a line 211 to fuel injection driving circuit 208.

Engine sensor system 114 supplies an input to block 212 for estimating the manifold surface temperature (TMS). Block 212 supplies this manifold surface temperature to block 213 which also has an input from engine sensor system 114 supplying the manifold absolute pressure in the RPM's of the engine. Block 213 finds the value of current equilibrium surface fuel quantity ($EISF_n$) from a look-up table using interpolation. Such a look-up table would be three dimensional and have the three coordinate axes of manifold surface temperature, manifold absolute pressure and RPM's. A block 214 is coupled to block 144 and supplies a constant value of the intake system time constant from a stored memory.

```
SELECT OPERATION 1070
SYNONYM IS PW-MODIFIERS
OPERATION 1070 DEFINITION
. EVALUATE TABLTF
                        FUNCTION 907 DEFINITION
                        PARAMETERS ARE (TABLE(COL,ROW,OUT) MAXIMUM
                        DIMENSIONS OF COL IS 4,ROW IS 4)
                      C TF VS, MCTF,TCF
                        FIND FN907 WHERE COL = MCTF,ROW = TCF
                        USING TABLE INTERPOLATION
                        END FUNCTION 907
. TF = FN907
.
. EVALUATE TABLMS
                        FUNCTION 905 DEFINITION
                        PARAMETERS ARE (TABLE(COL,ROW,OUT) MAXIMUM
                        DIMENSIONS OF COL IS 3,ROW IS 3)
                      C MSS VS, RPM,PI
                        FIND FN905 WHERE COL = RPM,ROW = PI
                        USING TABLE INTERPOLATION
                        END FUNCTION 905
. MSS = FN905
.
. EVALUATE TABLTU
                        FUNCTION 906 DEFINITION
                        PARAMETERS ARE (TABLE(COL,ROW,OUT) MAXIMUM
                        DIMENSIONS OF COL IS 3,ROW IS 3)
                      C TAU VS. RPM,PI
                        FIND FN906 WHERE COL = RPM,ROW = PI
                        USING TABLE INTERPOLATION
                        END FUNCTION 906
. TAU = FN906
.
. MP = MP + (MDOT * DELTAT)
. MDOT = ((MSS * TF) = MP) / (TAU * 60 * TF)
.
. LAMFT = (14.64 * MDOT * KFT) / AM
. .END OPERATION 1070
```

FIGS. 4, 5 and 6 are useful in connection with yet another embodiment of this invention using the following equation to determine $TRISF_n$.

$$TRISF_n = \frac{[(MSS)(TF)] - AISF_n}{(\tau)(TF)} \quad (3)$$

The above equation 3 has been derived from the more general equation (1) by replacing $EISF_n$ by the product of MSS (the steady state mass obtained from the Table of FIG. 5) and TF (the temperature factor obtained from the table of FIG. 4). Similarly, the denominator ISTC has been replaced by the product of $\tau$ (the time obtained from the table of FIG. 6) and TF (the temperature factor obtained from the table of FIG. 4). It can be appreciated that from the coordinates of the tables shown in FIGS. 4, 5 and 6 that MSS is a function of manifold absolute pressure and engine RPM's, $\tau$ is a function of manifold absolute pressure and engine RPM's, and TF (temperature factor) is a function of engine coolant temperature and manifold charge temperature.

Equation 3 is readily evaluated and can be easily programmed. Advantageously, the information contained in the tables of FIGS. 4, 5 and 6 is stored in the memory of a computer and is available for use by the program when solving equation 3. For increased accuracy, it may be advantageous to interpolate when the desired value is between the values shown in the table. For example, following is a sample program wherein $TRISF_n$ is designated as MDOT and $AISF_n$ is designated as MP. The left hand column indicates the actual program and the right hand column gives comments pertinent to the program's instructions.

Based upon the foregoing description of the invention, what is claimed is:

1. A fuel metering system for an internal combustion engine for determining a desired fuel flow rate based upon the mass of air flow into the engine and a desired air-to-fuel ratio, the engine having a passage through which a mixture of air and fuel is inducted into the combustion chamber or chambers of the engine, the fuel metering system comprising:

(a) a fuel system having electrically settable means for controlling the rate at which fuel is metered into the engine's intake passage, the fuel metering system determining the settings of the electrically settable fuel system without modification of the desired fuel flow rate except during selected conditions of engine operation, and providing an electrical signal that determines the setting of the fuel system;

(b) means for modifying the rate at which fuel is metered into the engine's intake passage to take into account the rate at which fuel is transferred from the surfaces of the intake passage to the inducted air/fuel mixture or from the inducted air/fuel mixture to the surfaces of the intake passage; said means for modifying the rate at which fuel is metered being a digital computer programmed to calculate repetitively a value representing a current transfer rate of the intake surface fuel and the calculated value being used to modify the rate at which fuel otherwise would be metered into the engine's intake passage by generating a control signal that modifies the desired fuel flow rate to take into account the rate at which fuel enters or leaves the inducted mixture as it passes through the intake passage;

said means for modifying the rate at which fuel is metered including:

means for calculating current equilibrium intake surface fuel quantity ($EISF_n$) as a function of engine operating parameters;

means for calculating the current intake system time constant ($ISTC_n$) as a function of engine operating parameters;

means for calculating current actual intake surface fuel ($AISF_n$) as a first order differential function of time, previous actual intake surface fuel ($AISF_{n-1}$), and previous transfer rate of intake surface fuel ($TRISF_{n-1}$); and means for calculating current transfer rate of intake surface fuel ($TRISF_n$) as a function of current equilibrium intake surface fuel quantity ($EISF_n$), current intake system time constant ($ISTC_n$), and current actual intake surface fuel ($AISF_n$), so that the transfer rate of the intake surface fuel is repetitively calculated and combined with the desired fuel flow rate to obtain the electrical signal that determines the fuel flow demand from the engine's fuel metering system, the engine operating parameters being used to determine the quantity of liquid fuel that would be present on the surfaces of the engine's intake passage under equilibrium conditions of engine operation and wherein the actual intake surface fuel in the liquid state on such surfaces determines the modification of the desired fuel flow rate, and the actual intake surface fuel is approximated from a previous transfer rate of the intake surface fuel.

2. A fuel metering system as recited in claim 1 wherein:

said means for calculating current equilibrium intake surface fuel quantity ($EISF_n$) is adapted to use as inputs manifold absolute pressure (MAP), RPM, manifold intake surface temperature, manifold intake time constant, time and air/fuel ratio.

3. A fuel metering system for an internal combustion engine for determining a desired fuel flow rate based upon the mass of air flow into the engine and a desired air fuel ratio, the engine having a passage through which a mixture of air and fuel is inducted into the combustion chamber or chambers of the engine, the fuel metering system compirsing:

means for calculating current actual intake surface fuel ($AISF_n$) and the transfer rate of intake surface fuel ($TRISF_n$) as a first order differential function of time and eqilibrium intake surface fuel ($EISF_n$), and wherein the intake system time constant (ISTC) is used as the time constant for the first order differential equation; and wherein said means for calculating current actual intake surface fuel ($AISF_n$) is based on previously calculated values of actual intake surface fuel ($AISF_{n-1}$) and a transfer rate of intake surface fuel ($TRISF_{n-1}$).

4. A fuel metering system for an internal combustion engine for determining a desired fuel flow rate based upon the mass of air flow into the engine and a desired air/fuel ratio, the engine having a passage through which a mixture of air and fuel is inducted into the combustion chamber or chambers of the engine, the fuel metering system comprising:

means for causing transition for the amount of fuel flow between two equilibrium points in accordance with the following differential equation:

$$MP = MP_i + (MDOT * DELTAT)$$

wherein

MP = equilibrium surface fuel $MP_i$ = actual surface fuel

MDOT = the first derivative of the actual surface fuel with respect to time

DELTAT = the intake system time constant.

5. A fuel metering system as recited in claim 4 including a computer means for carrying out the calculation of the differential equation, wherein MP is the forcing function and further including means for changing the forcing function as a function of time from a previous value of the forcing function.

* * * * *